United States Patent [19]

Rasmussen

[11] Patent Number: 4,512,118

[45] Date of Patent: Apr. 23, 1985

[54] CASING ARRANGEMENT FOR PARTITION END CAPS

[76] Inventor: Robert R. Rasmussen, 1120 Grandview La., Lake Forest, Ill. 60045

[21] Appl. No.: 554,964

[22] Filed: Nov. 25, 1983

Related U.S. Application Data

[62] Division of Ser. No. 277,226, Jun. 25, 1981, Pat. No. 4,443,984.

[51] Int. Cl.[3] ..... G09F 7/18

[52] U.S. Cl. ..... 52/39; 52/241; 52/242

[58] Field of Search ..... 52/39, 241, 238.1, 242

[56] References Cited

U.S. PATENT DOCUMENTS 3,861,103 1/1975 Rasmussen ..... 52/241
3,956,861 5/1976 Rasmussen ..... 52/287
3,998,027 12/1976 Wendt et al. ..... 52/242 X
4,151,691 5/1979 Wendt ..... 52/242

*Primary Examiner*—Carl D. Friedman

[57] ABSTRACT

Door, window, and partition casing arrangements for dry wall partitioning in which a basic casing member is provided to line and mask the opening made in the dry wall partitioning for the purpose of providing door and window or the like installations in the wall structure provided by the partition, with the casing member having a basic generic arrangement in the form of an elongated plate having a longitudinally extending web portion which lines and masks a portion of the partition opening itself, which plate includes a snap fit trim receiving channel portion, that is disposed along the margin of the adjacent wall surfacing defined by the partitioning about the opening provided. The casing arrangement cooperates with a T grid type supported ceiling wherein the casing upper portion interlocks with the horizontal flanges of the T bar.

3 Claims, 29 Drawing Figures

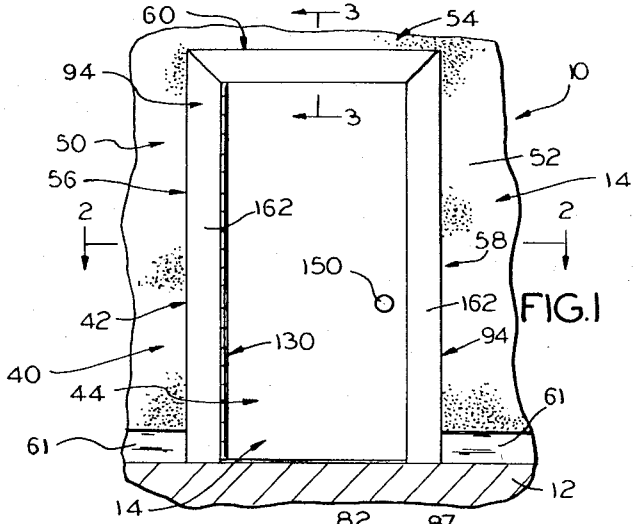
FIG.1
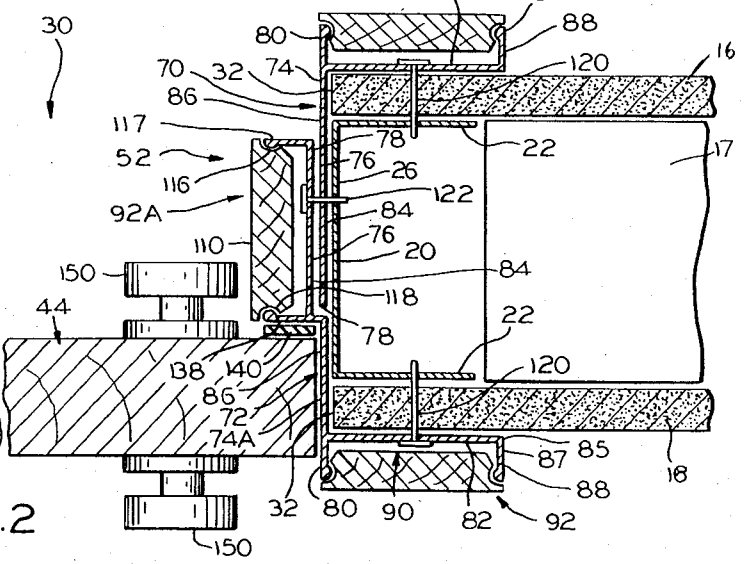
FIG.2
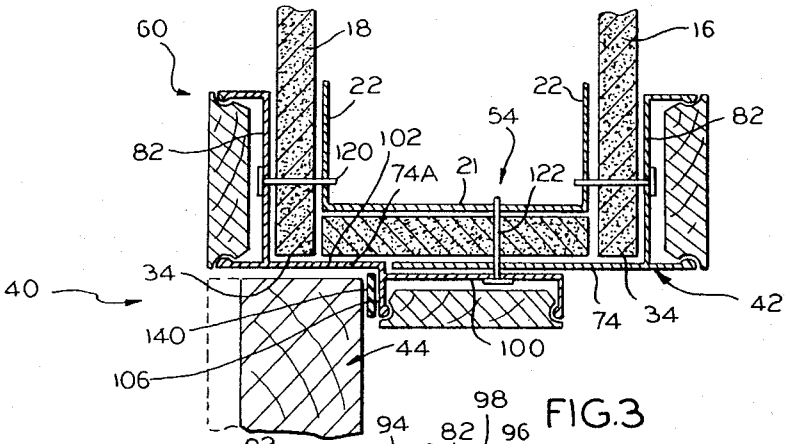
FIG.3
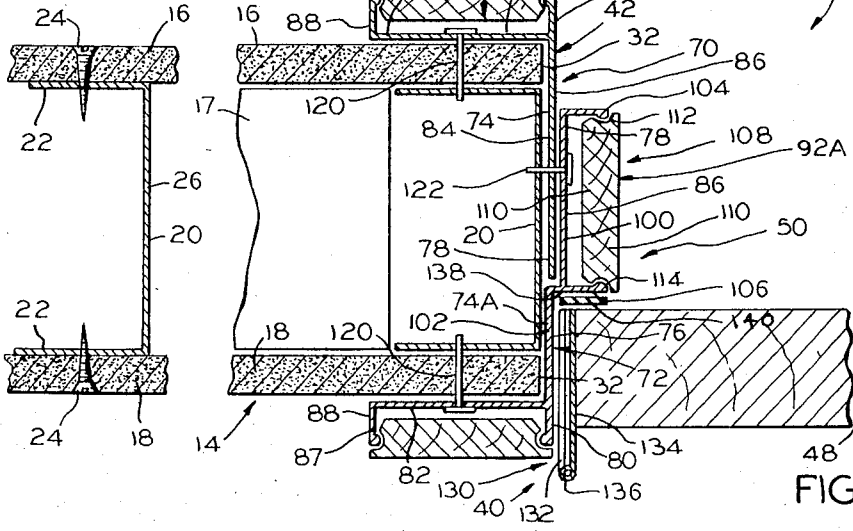

CASING ARRANGEMENT FOR PARTITION END CAPS

This application is a division of my parent application Ser. No. 277,226, filed June 25, 1981, now U.S. Pat. No. 4,443,984, granted April 24, 1984.

This invention relates to door, window, and partition arrangements for use with dry wall partitioning, and more particularly, to framing arrangements for forming the casing of doorways and window openings planned for dry wall partitioning construction.

Modern high rise and other construction for office, living and other facilities commonly involve a basic reinforced concrete skeleton that provides the building superstructure and enclosure, which leaves large open floor space of the individual floors of the building to be subdivided, this being conventionally done by relatively inexpensive non floating dry wall component assemblies providing partitions that are adapted for ready disassembly to accommodate redesign of floor layouts. My U.S. Pat. No. 3,861,103 discloses a floating type of partition arrangement involving dry wall partitioning of this general type, while my U.S. Pat. No. 3,956,861 discloses trim arrangements therefor (the disclosures of both said patents are incorporated herein as background information by this reference).

Dry wall partitioning conventionally employed to partition large open floor spaces of a building generally comprises ceiling and floor runners in the form of metal channels disposed in coplanar arrangement between which is assembled a panel assembly that forms the basic wall structure involved for individual rooms, walkways and hallways, and the like. The panel assembly involved usually comprises a series of metal studs of the familiar channel shaped configuration having the usual spacing (for instance, sixteen inches on center) which have secured to same to define either side of the wall involved, by suitable fasteners such as screws, wallboard sheets that ordinarily extend from the floor to the ceiling. Where doorways, window openings, or the like are to be provided for, the partitioning wallboard and studding is arranged to define the opening involved in which is pieced together from other the materials the casing that is to define the opening and mount the door or window or other structure that the opening is to be equipped with.

Heretofore the provision of the framing of the doorway, window or the like has frequently involved expensive carpentry work and assembly of framing components that are generally not systemized specifically for dry wall work, and are all too frequently supplied on a make do basis. The result frequently is that the work product appears inconsistent in design detailing, does not work satisfactorily, and provides minimal uniformity of appearance from one floor of the building to another. This type of installation is also complicated by having to accommodate different door forms for closets, pocket door arrangements, two, three and four way window and/or door arrangements, running partitions with mullions, and the like.

A principal object of the present invention is to provide doorway and window opening framing arrangements for dry wall partitions, and caps for suspended ceiling systems employing same, that are uniform and consistent in detailing, and in which the casings therefore are formed from metal extrusions that may be provided in selected standard lengths, from which stock the casing framing components that are to form the opening casings can be cut to size, as needed, at the work site to accommodate frequent variations in floor/-ceiling elevations.

The invention contemplates as a major objective that the framing members involved for defining a doorway or window opening shall involve a plate having a web portion that is to overlie the portions of the dry wall structure that define the opening itself at one end or entrance of the opening, and include a trim receiving socket that abuts the partition external wall surfacing that is in marginal arrangement about the doorway or window opening one end in question, which socket receives in snap fit relation thereto masking trim pieces that may be periodically replaced, which sockets also serve as a point of securement of the casing framing to the dry wall. The other end of the doorway or opening is similarly equipped, with the framing plates at the respective ends of the doorway or window involve being overlapped at the mid portion of the doorway or window opening for joint connection to studding of the dry wall structure masked thereby. The casing members involved are also equipped with trim piece receiving sockets through which the fasteners to the dry wall structure are applied to form the indicated joint connection so that the trim pieces will mask the fasteners when applied about the doorway or window opening, as the case may be.

Another important object of the invention is to provide a casing forming member for forming dry wall partition doorways, window openings and partition caps and the like having a basic generic arrangement which includes a web portion of planar configuration and a trim piece mounting socket of channel shaped configuration disposed normally of the web portion, from which basic shaping specific casing forming components or members for specific applications may be provided to satisfy specific requirements for particular types of door and window installations or the like to be provided for.

Another important object of the invention is to provide a dry wall partition doorway and window opening casing arrangement of split, self adjusting characteristics for accommodating tolerance variations that both masks the dry wall and studding involved at the opening they provide, and provides a system of mounting trim pieces of similar sizing that permits selection from a wide variety of aesthetic effects for trim pieces that are all mounted in a similar snap fit mannner for use and changeability as desired.

Another important object of the invention is to provide dry wall partitioning doorway and window opening casing forming components that may be used for either door or window installations, and in addition, the same components may be employed in a manner for forming mullions, and arrangements for door mounts of other than the standard hinged type, and the like.

Still other objects of the invention are to provide dry wall partition doorway and window opening casing forming arrangements that are inexpensive to manufacture, that may be readily cut to fit as needed and assembled on the job site, that are adapted to mount simple door and window equipment of standard and inexpensive design, that are simply applied, that permit standardization of appearance in a particular installation with abundant flexibility of aesthetic variations through standard trim piece mounting arrangements, and that have long life in use.

In accordance with the invention, assuming a doorway or window opening defined by a dry wall partition assembly that normally includes the usual metal studding at either side of and across the top of the opening, to the sides of which wallboard is secured to form the basic wall structure involved, the invention contemplates that for the two vertical sides or jambs and head of the opening, each such part of the opening would be equipped with a pair of casing frame members in which one of the frame members is mounted at one end of the opening and the other member is mounted at the other end of the opening. The frame members each include a web portion, with the web portions being proportioned for self adjusting overlapping relation. The frame members are shaped to define an internal corner portion for providing integral with the web portions a channel shaped socket extending the length of the frame member at least a portion of which is to overlie the margin of the partitioning that defines the opening side to which the frame member is applied. The respective sockets are arranged to receive in snap fit relation thereto trim members of standard width and shaping that have aesthetically decorated surfaces to provide any desired aesthetic effect. One of the casing frame members at the respective jambs and head of the opening has its web portion equipped with a similar trim member receiving socket for application of similar trim about the mid portion of the doorway or window. Both the trim receiving sockets have applied thereto the fasteners that connect same to the dry wall studding that is adjacent thereto, so that the trim members that are to be applied thereto will mask the fasteners as well as the dry wall.

The basic casing frame member structural arrangements involved may be employed to define either doorway or window openings, and variations of the structural framing involved accommodate the provision of special door arrangement, as for different types of through doors, closet doors, pocket door arrangements and the like.

Mullions, running walls, partition caps for suspended ceiling systems, and other special structures may also be accommodated using the basic approach of this invention.

Other objects, uses, and advantages will be obvious or become apparent from a consideration of the following detailed description and the application drawings in which like reference numerals indicate like parts throughout the several views.

In the drawings:

FIG. 1 is an elevational view of a dry wall partition equipped with a doorway casing arrangement and hinged door therefor in accordance with the invention, with the door shown in closed relation;

FIG. 2 is a horizontal sectional view of the dry wall partition and door arrangement shown in FIG. 1, taken substantially along line 2—2 of FIG. 1, but on an enlarged scale and with a portion of the door broken away;

FIG. 3 is a vertical cross-sectional view taken substantially along line 3—3 of FIG. 1 showing the head section of the door arrangement of FIG. 1 on the same scale as that of FIG. 2;

FIG. 21 is a diagrammatic transverse cross-sectional view illustrating the configuration of the basic casing frame forming member component of the invention while

Figure 13:
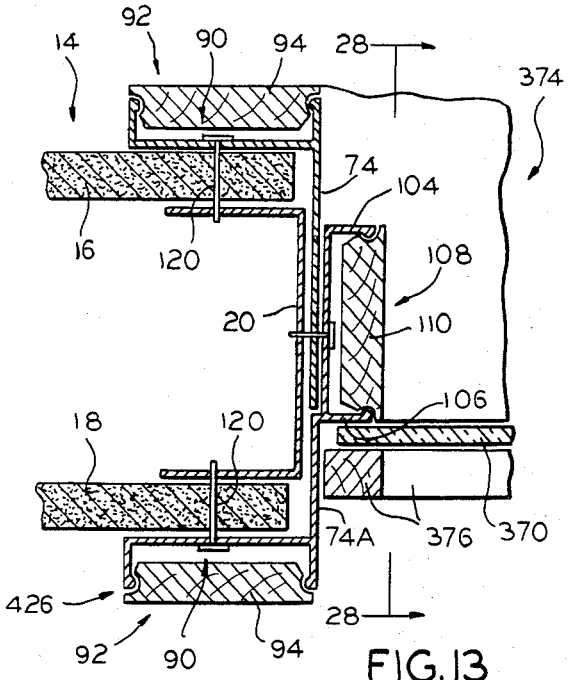
FIG. 13 is a horizontal sectional view through a dry wall partition defining a window opening, illustrating the window components that may be employed therein in accordance with the invention.
Figure 27:
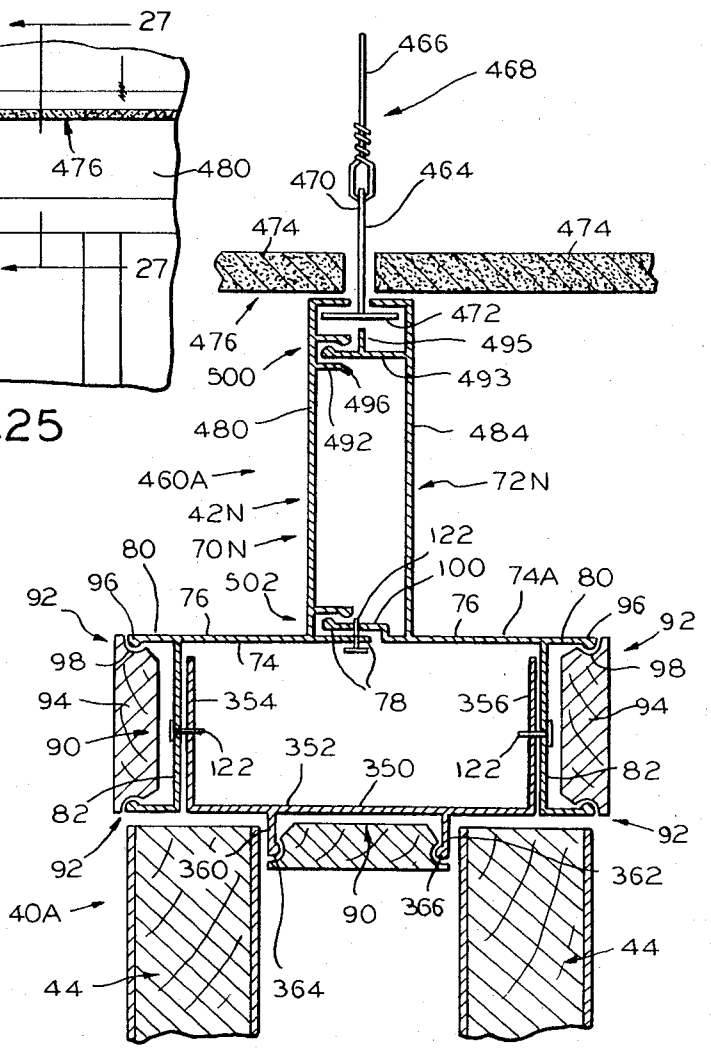
Figure 25:
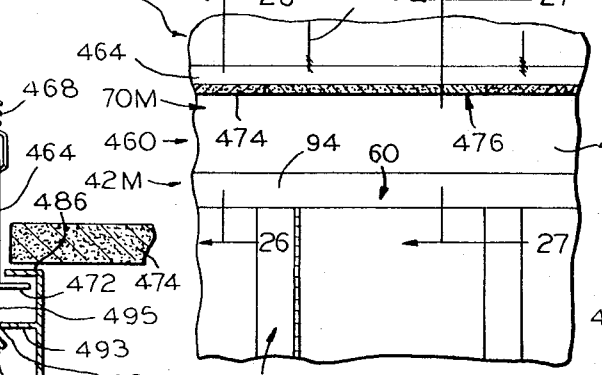
FIG. 25 is an elevational view similar to that of FIG. 1, but showing diagrammatically the partition between the door head section and the ceiling, illustrating a suspended ceiling system partition cap therefor arranged in accordance with the invention.
Figure 26:
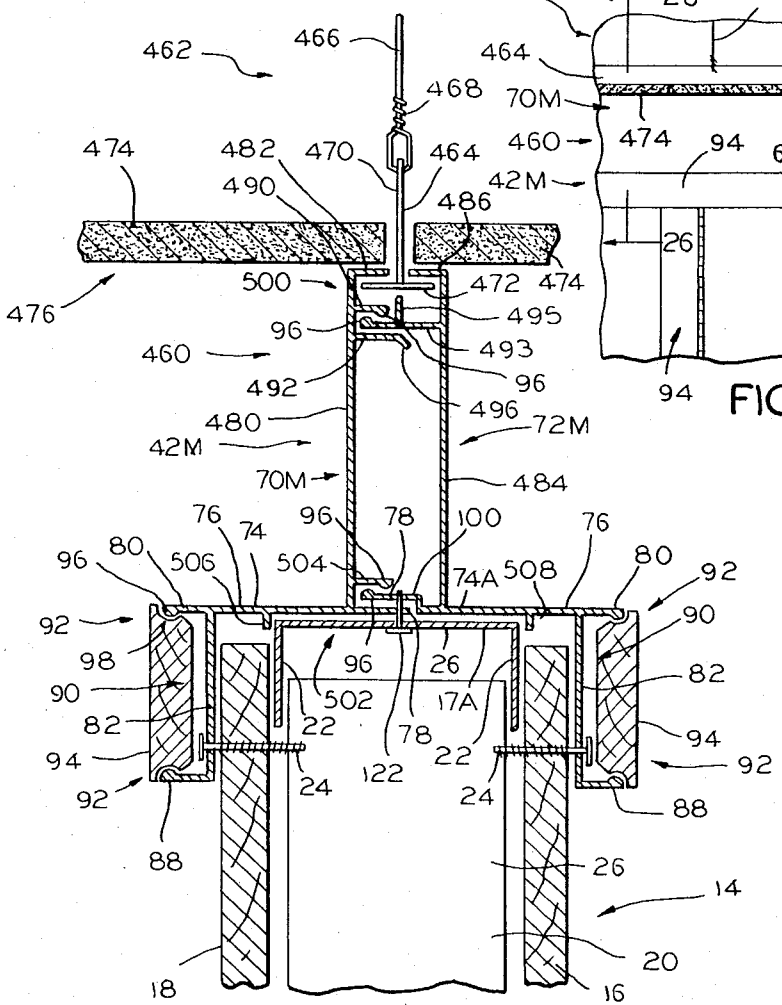
FIG. 26 is a vertical cross-sectional view similar to that of FIG. 3, but more specifically illustrating the partition cap of FIG. 25, and taken substantially along line 26—26 of FIG. 25.
Figure 28:
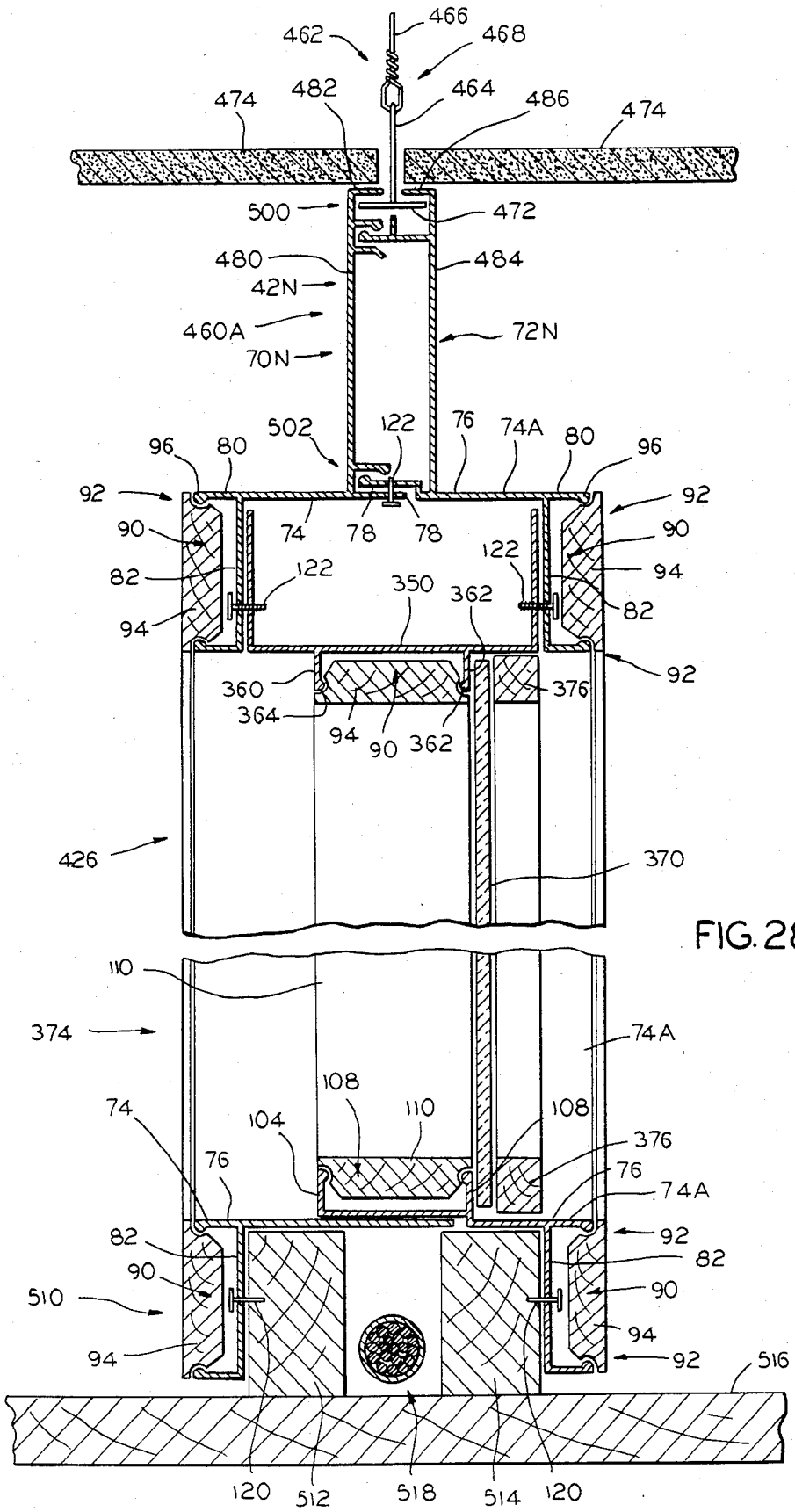

FIG. 27 is a vertical cross-sectional view similar to that of FIG. 26, but illustrating a partition cap arranged in accordance with the invention that includes a doorway head section for doorway arrangements of the type shown in FIGS. 1-3, and taken substantially along line 27—27 of FIG. 25; and FIG. 28 is a vertical cross-sectional view similar to that of FIG. 26, but illustrating a partition cap arranged in accordance with the invention for a window arrangement of the type shown in FIG. 13.

However, it is to be distinctly understood that the specific drawing illustrations provided are supplied primarily to comply with the requirements of the Patent Laws, and that the invention is susceptible of numerous modifications and variations that will be obvious to those skilled in the art, and that are intended to be covered by the appended claims.

GENERAL DESCRIPTION

Reference numeral 10 of FIG. 1 generally indicates a wall of the dry wall partition type applied to floor 12 of what may be assumed to be the floor portion of a typical building super structure formed of reinforced concrete or other suitable materials, of which the individual floors of the building are to be partitioned off into rooms, hallways, etc., for the purpose of defining office space, living quarters, etc.

The dry wall partitioning framework 14 comprising wall 10 in and of itself is conventional, and as indicated in FIGS. 2 and 3, the partitioning 14 typically includes wallboard sheets 16 and 18 secured to either side of upright studs 20 of the familiar metal channel shaped type. As is the usual practice in forming a running partition of this type, suitable runners 17, such as those shown in my said Patents, are applied to the ceiling and floor in vertical coplanar relation and the studs 20 are applied between same in suitable spacing, for instance sixteen inches on centers. The wallboard sheets 16 and 18 that form the opposite sides of the partition 14 are secured to the opposed flanges 22 of the studs 20, as by employing suitable dry wall screws 24. Studs 20 and runners 17 are, of course, of the familiar channel shaped configuration, thus defining web portion 26 that joins the flanges 22. For suspended ceiling systems, the ceiling runners are suspended from T grids that in turn are suspended from the building superstructure overhead floor. Floor runners are fixed in place using suitable fasteners such as ram set nails (not shown).

Wallboard sheets 16 and 18, and studs and the runners therefor 20 are arranged as needed in forming partitions 14, both for running partition purposes, and for forming openings that hereto form doorways, windows, or the like. In the showing of FIG. 2, the partition 14 is shaped to define doorway opening 30 and for this purpose two studs 20 are erected in spaced apart relation in the manner indicated, and wallboards 16 and 18 (which are on either side of suitable floor runners 17 spaced apart or interrupted to form opening 30) secured to their flanges 22 employing the indicated screws 24 or the like (not shown at that portion of FIG. 2 illustrating doorway 30 to avoid confusing the drawings). Over the doorway opening 30 a horizontal frame piece 21 of the same shape as studs 22 is suitably fixed in place, as by being suitably anchored to the studs 20 on either side of the doorway 30, and the wallboards 16 and 18 anchored to its flanges 22. The wallboard sheets 16 and 18 are suitably formed to define vertical edges 32 and horizontal edges 34 to define the outline of the doorway opening 30. And, of course, the doorway openings 30 may be of any proportion desired in terms of height and width, and window or other openings may be formed in the same manner. All such openings are hereinafter sometimes referred to generically as "service openings".

The applicant's invention is directed to providing a simplified but effective way of completing door and window installations on the site, and particularly with reference to the casings that are to form the doorway and window opening and also mask the wallboard sheeting and studding structure that defines the basic openings involved. The applicant's basic approach is to provide frame members that are to form the doorway and window casings of simplified configuration in extruded plate form that may be supplied in standard lengths and cut to fit to both form the doorway and window casings involved, and mask the service opening involved about its ends and inside surfacing with attractive trim strips that are also to be available in standard lengths and cut to fit as desired, and which may be pre-designed and color coordinated as desired in accordance with a predetermined decorative pattern. The invention is also concerned with the provision of dry wall partition caps for suspended ceiling systems that have similar aspects.

The showing of FIGS. 1-3 is illustrative of a standard door assembly 40 arranged in accordance with the present invention, which comprises a split door frame or casing 42 that mounts conventional vertically hinged door 44 to swing between the closed position shown in FIGS. 1 and 2, in which it may be locked employing conventional latching devices, and a full open position at right angles or more to the door full line (closed) position shown in FIG. 2, with the door swung clockwise of FIG. 2, to the open door position.

For purposes of description, the doorway 30 is considered to have approach ends 46 and 48 (see FIG. 2), which are thus disposed in more or less coplanar alignment with the respective partition sheets 16 and 18, respectively, with the frame or casing 42 being applied about the two vertical sides or jambs 50 and 52 and head 54 of the doorway.

The door frame or casing 42 comprises a pair of side casing sections 56 and 58, and head section 60, all of which are formed from the same materials that may be presupplied, for instance, in extruded aluminum strips in standard lengths, and cut to required length as needed for accommodating the opening for assembling purpose. The partition base trim indicated at 61 in FIG. 1 may be one of the base trim forms disclosed in applicant's said U.S. Pat. No. 3,956,861.

The side sections 56 and 58 of the door frame or casing 42 are identically arranged but reversely oriented since they are on opposite sides of the doorway 30. Head section 60 is likewise identical to the side sections 56 and 58, but its components are horizontally disposed as the doorway head is involved.

The door frame or casing sections 56, 58 and 60 each comprise a first frame member 70 applied to one end of the doorway 30 and a second frame member 72 applied to the other end of the doorway. The members 70 and 72 are substantially identical and each comprises the respective plates 74 and 74A formed from aluminum or the like and defining a generally flat web or base flange 76 that has the function of masking the margin of the doorway 30 to which the respective plates 74 and 74A are applied. Plates 74 and 74A each define marginal end portions 78 and 80 that extend longitudinally of and for the length of the plates 74 and 74A respectively, as does the web 76.

At the marginal edging 80, the plates 74 and 74A are shaped to define wing flange 82 that projects from the partition facing side 84 of same, as distinguished from the doorway defining side 86 of same. The wing flanges 82 thus extend laterally of the respective plates 74 and 74A and are formed along their projecting end portions 85 with a stub flange 88 that together with the marginal edging 80 of the respective plates 74 and 74A defines a channel shaped trim strip receiving socket or recess 90 that provides a snap fit mounting device 92 to which trim strip 94 is applied. For this purpose, marginal edge portion 80 of the respective plates 74 and 74A and the stub flange 88 thereof are formed with opposed rounded beads 96 that extend longitudinally of and for the length of the respective plates 74 and 74A, and the trim pieces or strips 94 are formed with correspondingly shaped indentations or grooves 98 for snap fit application thereto to the respective sockets or recesses 90, as will be discussed in detail later.

As will be observed from the showing of FIGS. 2 and 3, the plates 74 and 74A are applied to the indicated ends 46 and 48 of the doorway 30 with their web portions 76 in overlapping relation. The overlapping separate entity structural relationship of the plates 74 and 74A thus provides a split casing arrangement in the sense that the plates 74 and 74A are adjustable toward and away from each other to accommodate partitions 14 of varying thickness tolerances.

As indicated in FIGS. 2 and 3, the web portion 76 of plate 74A has a section 100 offset from its other section 102, but in parallel relation thereto, to receive the web portion 76 of the plate 74 it cooperates with, in overlapping relation thereto. The web section 100 of plate 74A is also formed on its door opening defining side 86 with a pair of opposed stub flanges 104 and 106 that project in parallelism centrally of the doorway 30 and that are normally disposed with respect to the web portion 76 of the plate 74A. The stub flanges 104 and 106 define trim mounting socket or recess 108 in which trim member 110 is mounted, with the stud flanges 104 and 106 being formed to define rounded beads 112 and 114 that are adapted to be received in snap fit relation with recesses 116 and 118 of trim strip 110. In the form shown in FIGS. 2 and 3, the trim stripping 110 is the same as trim member 94, the specifics of which will be described hereinafter in connection with the showing of FIGS. 21-24. Socket or recess 108 thus forms snap fit mounting device 92A which structurally is the same as device 92.

Prior to the application of the trim members 94 and 110 to their mounted positions, the plates 74 and 74A are cut to fit to define the door casing side frames or jambs 56 and 58 and head 60. These components may be mitered, as indicated in FIG. 1, for close fitting relation at the juncture of the door casing jambs and head, in accordance with good workmanship practices.

In any event, plates 74 of the casing side frames or jambs 56 and 58 and head 60 are applied about the doorway approach end 46, with these components being secured in place by suitable fasteners 120 penetrating the respective wing flanges 82, the underlying wallboard 16, and the adjacent stud flanges 22.

Plates 74A are applied in a similar manner about the margin of the doorway opening approach end 48, with similar fasteners 120 applied to their wing flanges 82 and the adjacent stud flanges 22 through wallboard 18 to mount these components in place, with the web sections 100 of the plate 74A in overlying relation to the web portion 76 of the plates 74. The overlapping web portions of the plates 74 and 74A are then affixed to the adjacent stud 20, and specifically its web portion 26, employing suitable fasteners 122. Fasteners 120 and 122, which are only diagrammatically illustrated, may be in the form of conventional dry wall screws or pop rivets and are spaced apart longitudinally of and applied through the respective plates 74 and 74A as needed for secure fastening in place of these casing components.

In this respect, in the showing of FIGS. 2 and 3 as well as other views of the drawings, the adjacent portions of the plates 74 and 74A as well as the adjacent portions of the wallboard sheets 16 and 18 and studs 20 are shown in somewhat spaced apart relation for a better understanding of the shaping of the parts involved. In practice, the wallboard sheets 16 and 18 abut the stud flanges they are secured to, and the web portions 76, of plates 74 and 74A are in abutting relation to the surfaces of the wallboard sheets 16 and 18 adjacent to same, as are the wing flanges 82. Similarly, the fasteners 122 draw the plate web portions 76 against the stud webs 26 in firm surface contacting relation, as will be apparent from the nature of the structural relationships involved.

As the opening 30 is a doorway, and the door assembly 40 is of the standard hinged type, one of the plates 74 and 74A then forming the door jambs will have applied to same a conventional hinge 130 of the piano hinge type that conventionally comprises leaf 132 and leaf 134 hingedly connected by pin 136. In the arrangement shown in FIGS. 1-3, the hinge 130 is secured to the plate 74A at the end 48 of the doorway and on the left hand side of FIGS. 1 and 2, and for this purpose, the hinge leaf 132 is suitably affixed to web portion 76 of plate 74A in any suitable manner, as by screws, brazing, mechanical bonding, or the like. This may be conveniently done before the plate 74A that is to bear the hinge 130 is mounted in its operating position.

In addition, the stub flanges 106 of the plate 74A have their surfaces 138 that face the marginal edgings 80 of the plate 74A covered with sound asorbent or deadening stripping 140 which may be in the form of felt or the like. The stripping 140 is conveniently secured in place by employing a suitable bonding adhesive or the like.

As indicated, the plates 74 and 74A forming the door casing head 60 are applied across the doorway opening 30 in a similar manner, as indicated by the showing of FIG. 3. Suitable fasteners 120 are employed to affix the wing flanges 82 of plates 74 and 74A to the horizontally disposed support member flanges 22, while suitable fasteners 122 secure the web portions 76 of the head plates 74 and 74A to the web 26 of the support member 21. The stud flange 106 of the head plate 74a has sound deadening stripping 140 applied thereto in the same manner as the corresponding stub flanges of the jamb forming plates 74A.

Of course, the fasteners 120 and 122 are applied to the plates 74 and 74A prior to application of the trim strips 94 and 110 to the respective plates involved, after which the indicated trim strips may be applied to their respective trim mounting devices 92 and 92A, which are conveniently of the same size for interchangeability of mounting of trim strips 94 and 110.

Door 44 is illustrated as an all wood door which has hinge leaf 134 suitably secured thereto, as by employing screws or the like. The door 44 includes suitable door knob 150 and associated latching device for releasably latching the door in its closed position shown in FIG. 1, to a suitable striker applied to the right hand plate 74A (in the showing of FIG. 2) the specifics of which may be conventional and are not illustrated to simplify the drawings.

Referring now specifically to FIGS. 21–24, the trim stripping illustrated in FIGS. 2 and 3 as trim stripping 94 and 110 is shown in greater detail together with several alternate forms of trim stripping, as coordinated with the basic plate arrangement involved in casing or frame plates 74 and 74A.

Figure 22:
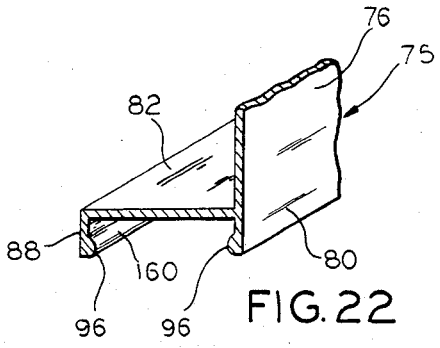
FIG. 22 is a fragmental perspective view of same.
Figure 21:
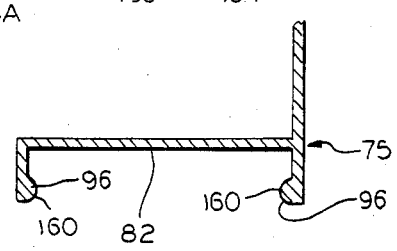

In the showing of FIGS. 21 and 22, the basic shaping of the plates 74 and 74A is illustrated as plate segment 75, including web portion 76, marginal edge portion 80, wing flange 82, stub flange 88, and the snap fit beads 96. As indicated in FIGS. 21 and 22, the beads have an external surfacing 160 that is essentially semicylindrical in configuration and the beads 96 extend the length of the plates 74. The plates 74 and 74A, of course, include marginal edges 78 that are not illustrated in FIGS. 21 and 22; however, it is a feature of the invention that the web portions 76 of the plates 74 and 74A and their edge portions 78 may be shaped in various ways to accommodate specific needs for installation purposes. In the door casing arrangement 42, the web portions 76 of the plates 74A are offset to define the offset sections 100 for the indicated overlapping relation with the web portions 76 of the plates 74. However, for other types of dry wall partition defining openings or marginal edgings the corresponding portions of the basic plate arrangement represented by the plate segment 75 may be varied as needed to serve specific ends, as will be apparent as the disclosure proceeds.

Figure 23:
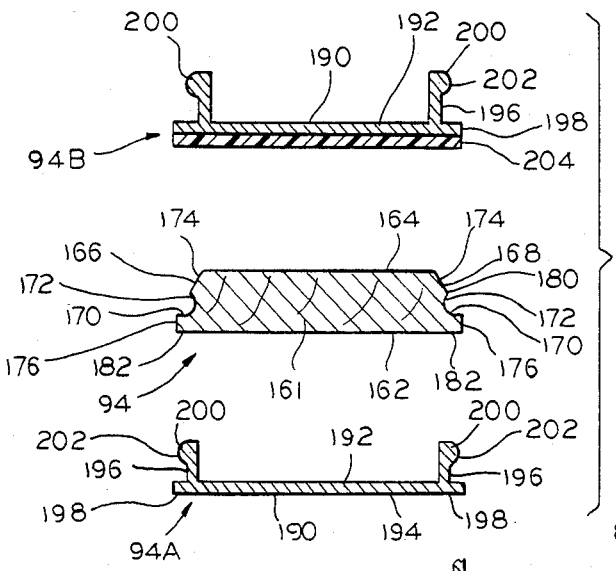
FIG. 23 illustrates three varient forms, in section, of trim members that are adapted for snap fit relation with the basic casing frame member of FIGS. 21 and 22.
Figure 24:
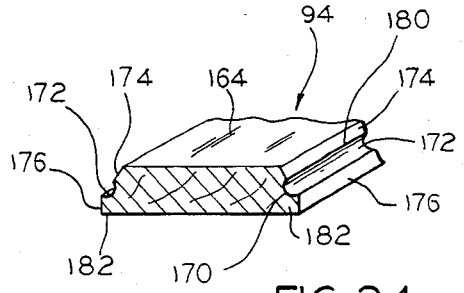
FIG. 24 is a fragmental sectional view of one of the trim members shown in section in FIG. 23.

The general nature of trim strips 94 and 110 is more specifically brought out in FIGS. 23 and 24. In FIG. 23 the trim strip is designated by reference numeral 94, and it is shown for comparison purposes in the same view with alternate trim strips 94A and 94B. The trim strip 94 is formed from a length of wood to define generally flat parallelipiped body 161 having a planar front face 162, planar back face 164, and side edges 166 and 168 of the special configuration indicated to provide the snap fit mounting relationships hereinbefore referred to.

Edges 166 and 168 thus each include concave recess 170 defined by semicylindrical wall surfacing 172, diagonally angled planar edge surfaces 174 that are angled so that their planes converge at a point spaced from the back surface 164, and planar edge surfaces 176 that are perpendicular to the trim strip front surfacing 162. The surfaces 172, 174 and 176 along either side edge 166 and 168 of the trim strip 94 (and trim strip 110) extend continuously thereof, as suggested by the showing of FIG. 24.

The dimensioning of the trim stripping 94 and 110 relative to the trim strip mounting sockets 90 and 108 is such that when a length of the trim stripping 94 or 110 is applied to a socket or recess 90 or 108, for instance socket 90, the diagonal edge surfaces 174 are placed in camming relation with the respective beads 160 of the plates 74 and 74A. By pressing inwardly of the socket 82, the corners 180 defined by the merging of surfaces 174 and 172 are snapped past the beads 160 to seat the trim stripping 94 in the mounted position that is indicated in FIGS. 2 and 3. In this connection, the proportion of parts is such that the beads 160 lightly grasp the surfaces 172 defining the grooves or recesses 170 to firmly and compressingly hold the trim strips 94 and 110 in mounted position. Of course, the trim strips 94 and 110 are applied in a similar manner to either of sockets 90 and 108, the beads 116 and 118 of which are contoured and hold the trim strips 94 and 110 in the same manner as beads 160.

In this connection, as indicated in FIGS. 2 and 3, in the applied position of the trim strips 94 and 110, the outer edges 182 of the trim strips overlie and thus mask the trim strip receiving socket beads 96, 116 and 118, it being desirable that the parts be proportioned such that the side surfaces 176 are aligned with the corresponding surfaces 86 and 87 of the plates 74 and 74A, and the outer side surfaces 117 and 138 of stub flanges 104 and 106.

It is also pointed out that the spacing between the bead surfaces 160 and the stripping surfaces 172 that is shown in FIGS. 2 and 3 and subsequent views is solely to better emphasize the shape of the parts involved; in practice, bead surfaces 160 are in abutting relation with the trim groove surfaces 172.

The trim strip embodiment 94A comprises a one piece plate 190 formed from aluminum or the like by a suitable extrusion procedure and defines planar plate portion 192 having planar facing surface 194, and stub flanges 196 along either side edge of same that are provided with the respective beads 200 that have a shaping comparable to beads 96 of plates 74 and 74A and thus define semicylindrical bead surfaces 202. The stub flanges 196 and their respective beads 200 are proportioned so that trim strip 94A may be snap fit mounted in sockets 90 and 108 by snap fitting beads 200 of the strips 94A past beads 96 of plate members 74 and 74A, or beads 116 and 118 of the blade sockets 108, which disposes the trim strips 94A in mounted position wherein they are disposed in a manner similar to the showing of strips 94 in FIGS. 2 and 3.

The trim strip 94B is the same as trim strip 94A except for appearance purposes it has a layer 204 of a suitable plastic laminated on surface 194 in any suitable manner. The plastic layer 204 may be colored as desired for aesthetic purposes. It will be apparent that instead of a plastic layer being applied to the plate 190, piled fabrics or the like may also be laminated to achieve desired aesthetic effects.

Figure 20:
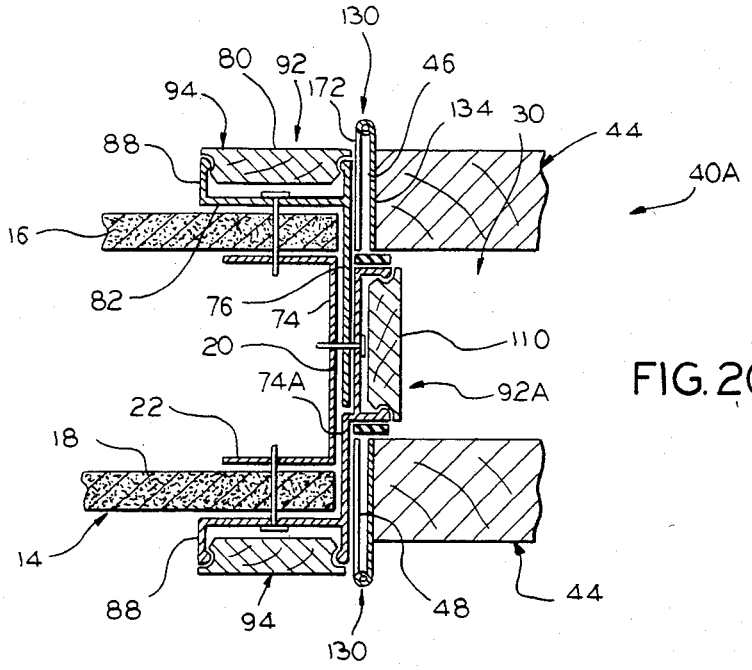
FIG. 20 is a horizontal sectional view illustrating the door frame arrangement of FIG. 2 equipped with double doors.

In the embodiment 40A of FIG. 20, the door casing 42 is the same as casing 42 of the embodiment of FIGS. 1–3. In the embodiment of FIG. 20, a second door 44 is applied on the end 46 of the doorway 30 having the same parts and components as the door 44 of FIG. 2, as indicated by corresponding reference numerals to the extent that the doors 44 are illustrated in FIG. 20. Thus, the hinge 130 of the second door 44 has its leaf 132 suitably affixed to the plate 74, and specifically its web portion 76 at edge portion 80. The embodiment of FIG. 20 is otherwise the same as the embodiment of FIGS. 1–3.

VARIENT EMBODIMENTS OF THE INVENTION

FIGS. 4–19 illustrate different applications of the basic split casing or frame arrangement of this invention that may be employed to form other types of door openings, window openings, or be employed for other purposes in association with partitioning equipment or structure normally associated with dry wall partitioning.

Figure 5:
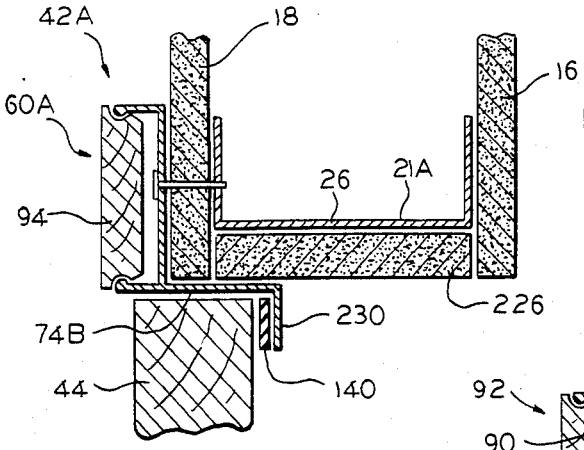
FIG. 5 is a view of the partition defined doorway and associated parts of the embodiment of FIG. 4, at the head section of the door and thus is comparable to the showing of FIG. 3.
Figure 4:
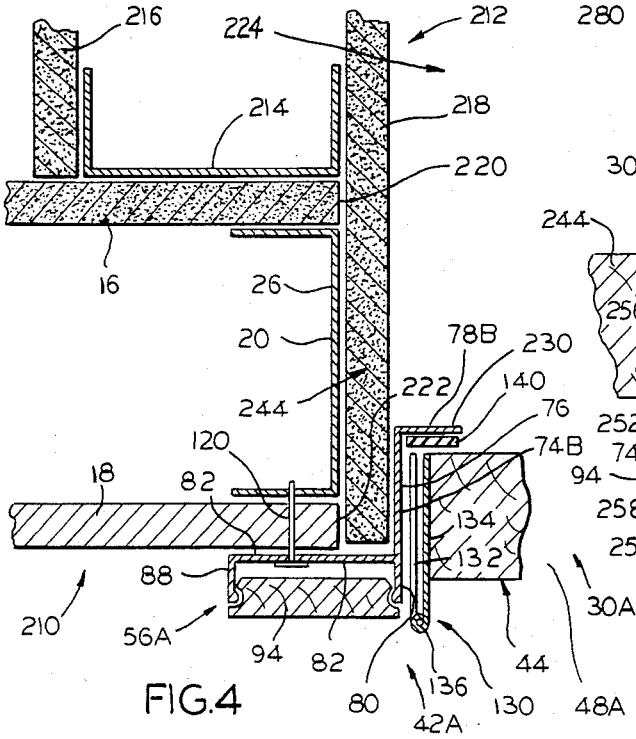
FIG. 4 is a sectional view similar to that of FIG. 2, showing only one side of the doorway defined by a dry wall partition arrangement which defines a closet, illustrating the nature of the casing side frame member employed for this embodiment of the invention, with the other side of the doorway and associated parts being omitted since they are consistent in detail, to simplify the drawings.

FIGS. 4 and 5 illustrate a casing 42A as applied to dry wall partitioning 210 to form a closet doorway 30A equipped with a door 44 and its hinge 130.

In the specific dry wall partitioning 210 that is illustrated, wallboard sheets 16 and 18 are affixed to the usual stud 20 employing suitable fasteners for this purpose (not shown) and a wall 212 joins wall 210 at stud 214 (that is the same as stud 20) and has wallboard sheets 216 and 218 suitably affixed thereto employing the usual suitable fasteners (not shown). Sheet 218 in this instance is extended to overlie the web 26 of the stud 20 as well as the ends 220 and 222 of the respective wallboard sheets 16 and 18. Doorway 30A to closet 224 is defined by the partitioning indicated in FIG. 4 as well as similar partitioning on the other side of the doorway that is not illustrated. The head of the doorway 30A is defined by wallboard sheeting 16 and 18 being suitably apertured and connected together by bracing member 21A, similar to the head arrangement of FIGS. 1-3. Wallboard strip 226 is suitably affixed to the web 26 of the support 21A, as by employing suitable fasteners similar to those illustrated in FIG. 2.

The casing 42A comprises side frame or jamb sections 56A applied to either side of the doorway 30A and head section 60A applied to the head of the doorway 30A.

The jamb and head sections 56A and 60A, respectively, each comprise a plate 74B that has the same basic components that plates 74 and 74A, and plate segment 75, have as indicated by corresponding reference numerals. Thus, plate 74B has web portion 76, marginal edge portion 78B in modified form, marginal edge portion 80, wing flange 82, its stub flange 88, trim strip socket 82 and trim strip 94.

In the embodiment of FIGS. 4 and 5, the marginal edging 78B of the plate 74A is in the form of planar stub flange 230 to which sound absorbing stripping 140 is applied in the same manner as in connection with plates 74A. Hinge 130 is applied to the casing jamb sections 56A in the same manner as in the embodiment of FIG. 2 (the fasteners themselves being omitted to simplify the drawing).

The plate 74B is the same for both jamb sections and head section 64A, and is applied only about the approach end 48A of doorway 30 stub it being secured to the adjacent stud or support by suitable fasteners 120. The edge of door 44 of the embodiment of FIGS. 4 and 5 that is not shown is arranged in the same manner as shown in FIG. 2 to cooperate with the jamb section 56A that is on that side of the doorway 30A, whereby the door 44 of FIGS. 4 and 5 functions as a closet door hinge for movement about a vertical axis to open and close the door.

Figure 6B:
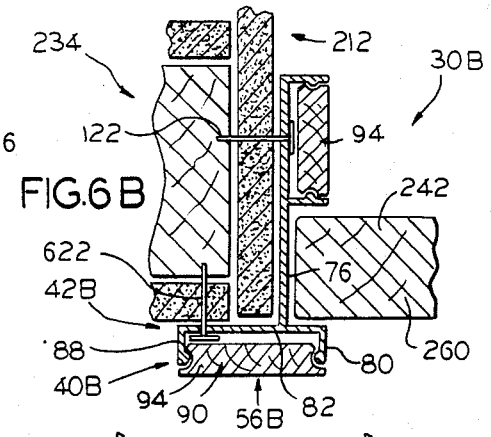
FIGS. 6A and 6B are composite views of the horizontal sectional view type comparable to that of FIG. 2 showing the invention embodied in a bypass sliding closet door frame arrangement
Figure 7:
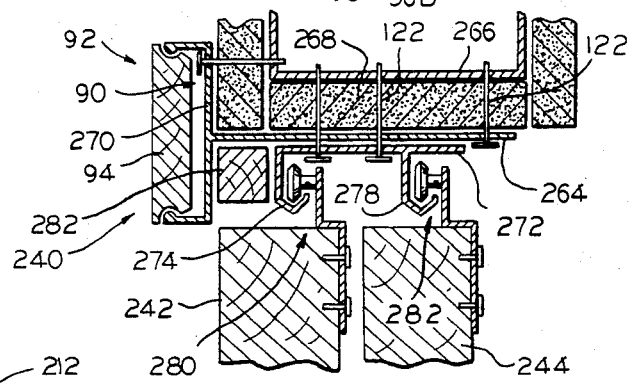
FIG. 7 is is a view comparable to that of FIG. 3 illustrating the head section of the door frame arrangement of FIGS. 6A and 6B.
Figure 6A:
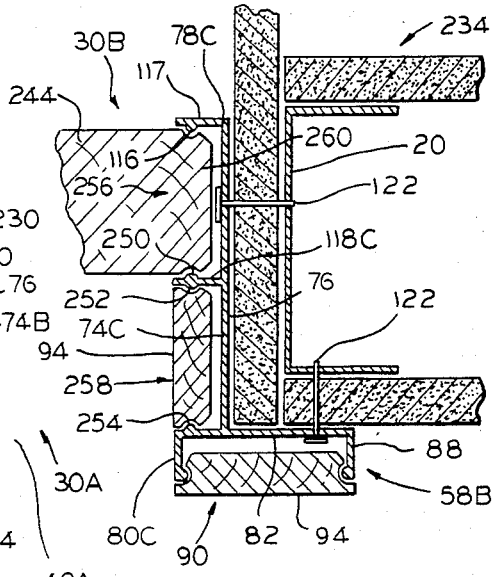

In the embodiment 40B of FIGS. 6A, 6B and 7, the partitioning 234 defines a doorway 30B. The door assembly 40B is provided comprising door casing 42B in the form of side frame or jamb sections 56B and 58B and head section 240, for sliding doors 242 and 244 that form bypass sliding closet door arrangement 40B.

The door casing side frame or jamb sections 56B and 58B are similar to jamb member 72, as indicated by corresponding reference numerals, including plate 74C, web portion 76 and its marginal edge portions 78C and 80C, wing flange 82 and its stub flange 88, the snap fit socket 90 defined thereby into which trim stripping 94 or its disclosed equivalents may be applied.

The plate 74C varies from the corresponding plates 74 and 74A previously described in that wing flange 82 is shifted relative to web portion 76 so that the wing flange 82 projects to either side of the web 76. Web 76 is formed with step flange 117 and the modified stub flange 118C, with the stub flange 117 including its bead 116 and the stub flange 118C having similar beads 250 and 252 on either side of same; plates 74C also include bead 254 which opposes bead 252 and is similar thereto.

The plates 74C are applied to the partitioning in a manner similar to plates 74A, employing suitable fasteners 122 to secure them to the adjacent studs 20, as indicated in FIGS. 6A and 6B. The plates 74C define a pair of sockets or recesses 256 and 258, which, for the plate 74C on one side of the doorway 30A, serve to mount trim member 94 in the same manner as socket 108, and serve as a stop for the back or rear end 260 of one of the doors 44, while on the other side of the casing the sockets 256 and 258 serve the reverse purpose (compare FIGS. 6A and 6B).

The head section 240 of the door embodiment 40B comprise a planar plate 264 suitably fixed to the supporting channel shaped cross support 266 through the underlying wallboard sheeting 268, as by employing suitable fasteners (not shown), which plate 264 is integral with cross flange 270 shaped to define a snap in socket arrangement 92 for applying trim 94 or its equivalent thereto. Anchor plate 272, formed to define tracks 274 and 278 is suitably affixed to support member 266, with the doors 242 and 244 being provided with suitable roller devices 280 and 282 that ride on the respective tracks 274 and 278 in a manner usual and customary for bypass sliding doors. Cross bar 282 serves as a spacer between track 274 and cross flange 278, and is secured in place in any suitable manner.

Figure 9:
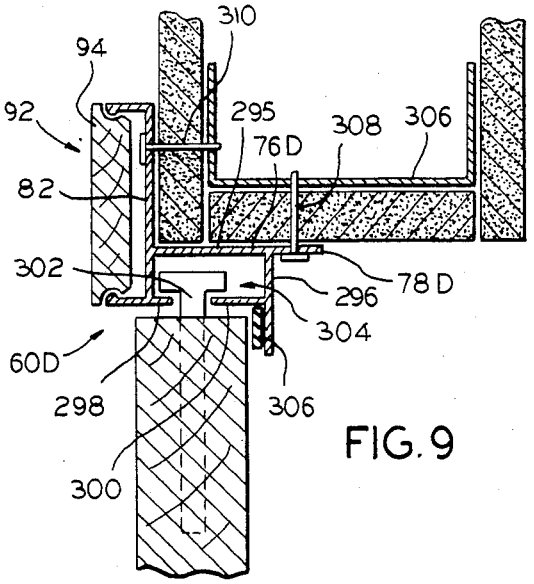
FIG. 9 is a view comparable to the showing of FIG. 3 illustrating the head section of the door frame arrangement and associated parts of FIG. 8.
Figure 8:
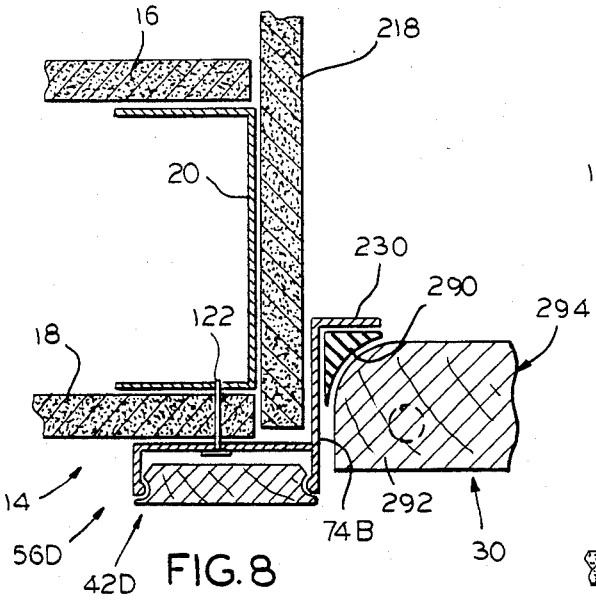
FIG. 8 is a horizontal sectional view through one side of a dry wall partition defined doorway and associated parts for a bifold closet door arrangement.

In the embodiment of FIGS. 8 and 9, partition 14 forms the doorway 30 to which is applied door casing 42D comprising side frame or jamb sections 56D on either side of the doorway 30 and special head section 60D.

The jamb sections 56D are the same as jamb sections 56A of FIGS. 4 and 5 and are secured in place in the same manner as jamb sections 56A, employing the suitable fastening devices 122. The stub flange 230 of the plate 74B has applied thereto a felt body 290 against which the leading edge 292 of the byfold door assembly 294 seats in the closed relation of the door assembly.

The head section 60D comprises plate 295 includes web 76D, wing flange 82 that is disposed to project on both sides of the web portion 76D, and a snap fit socket device 92 to which the trim strip 94 or one of its equivalents is applied. Plate 295 also includes cross flange 296 adjacent the marginal edging 78D of plate 295 and is integral with plate portions 298 and 300 that parallel the web portion 76D and are spaced apart to receive the folding door glides 302 on trackway 304. Felt stripping 306 may be applied to cross flange 296 for sound deadening purposes. Plate 295 is affixed to support member 306 by suitable fasteners 308 and 310.

Figure 11:
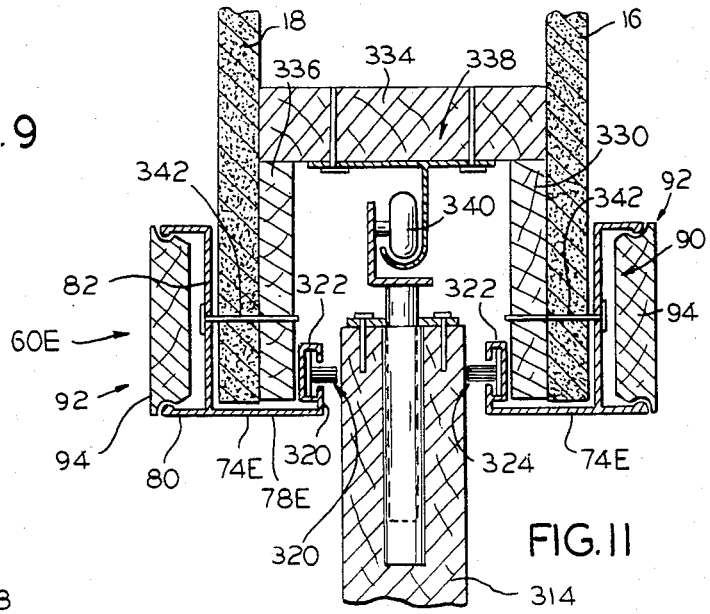
FIG. 11 is a head sectional view comparable to the showing of FIG. 3 for the arrangement of FIG. 10.
Figure 10:
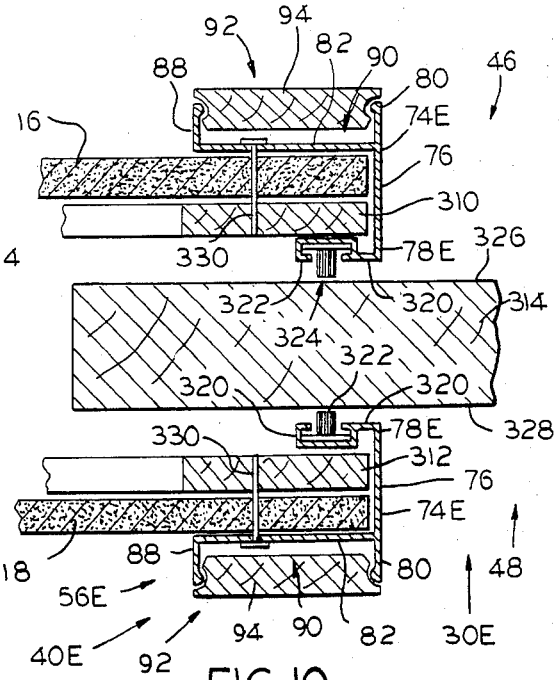
FIG. 10 is a horizontal sectional view through one side of a pocket door frame arrangement in accordance with the invention.

In the embodiment of FIGS. 10 and 11, a pocket door 40E is provided. In this arrangement, the wallboard sheeting 16 and 18 terminates at the door opening 30E, with the sheeting at this point being suitably affixed to upright supporting planks 310 and 312. The door assembly 40E comprises composite side frame or jamb sections 56E on either side of the door and head section 60E.

The door frame or casing jamb sections on each side of the doorway 30E comprise a pair of plates 74E located at the respective ends 46 and 48 of the doorway 38E, between which sliding door 314 operates.

The plate 74E comprises the same basic cqmponents as illustrated in FIG. 22 and thus include web portion 76, its marginal edge portions 78E and 80, wing flange 82, stub flange 88, and the snap fit socket device 92 to which trim strips 94 or their equivalents may be applied. The plates 74E at their marginal edges 78F are formed with stub flange 320 that is integral with the channel shaped housing 322 to which suitable closure stripping or its equivalent 324 is applied in brushing relation with the respective side surfaces 326 and 328 of the door 314.

The plates 74E are affixed to the upright supports 310 employing suitable fasteners 330 before trim strips 94 are applied thereto. Fasteners 330 are applied as needed along the lengths of plates 74E.

The head section 60E of the casing is similarly arranged as indicated by corresponding reference numerals.

The partitioning to which the head section 60E is secured is arranged in the modified manner indicated in FIG. 11, whereby the wallboard sheets 16 are affixed to suitable cross members 334, 336 and 338 mounted in any suitable manner and equipped with conventional trackway device 338 on which door 313 rides by way of supporting rollers 340, as will be clear to those skilled in the art. The plates 74E of head section 60E are affixed in place employing suitable fasteners 342 applied to their winged flanges 82 into the supporting members 336 and 370, respectively.

FIGS. 12–19 illustrate other dry wall partitioning structural features in which the plates 74 and 74A of the casing embodiment of FIG. 1–3 may be employed with facility.

Figure 12:
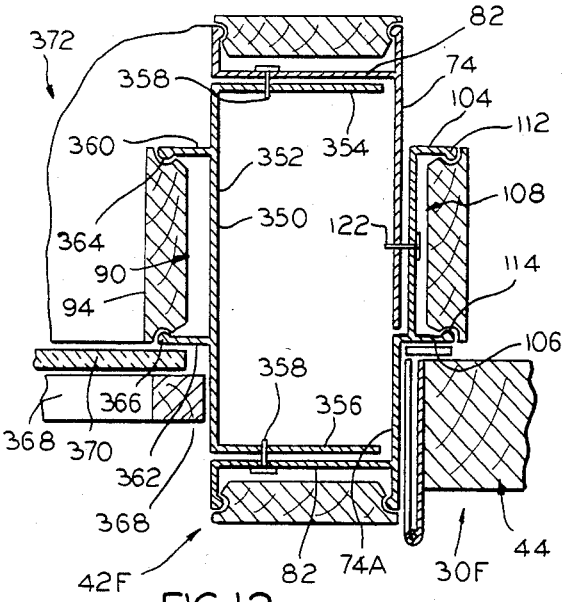
FIG. 12 is a horizontal sectional view illustrating the principles of the invention applied to a door frame arrangement of the type shown in FIG. 2 at the end of a glass partition.

In the showing of FIG. 12, the plates 74 and 74A are employed to form a casing 42F for doorway 30F in which the door 44 is swingably mounted in the manner shown in FIG. 2, with the plates 74 and 74A also being affixed to the special channel shaped plate 350 defining web portion 352 and spaced flanges 354 and 356, to the latter of which the respective wing flanges 82 of the respective plates 74 and 74A are affixed employing suitable fasteners 358. Plate 350 is formed with spaced stub flanges 360 and 362 equipped with beads 364 and 366 that are identical to the beads of the snap fit sockets 90 and 108 for snap fit application thereto of the trim strips 94 or their equivalents applied between the stub flange 362 and wooden frame members 368 is a plate of glass 370 that defines window installation or arrangement 372.

The plate 350 has a height comparable to that of plates 74 and 74A, in which case the window installation 372 formed by the arrangement of FIG. 12 may have a height comparable to the door jamb sections defined by plates 74 and 74A. The other side of the window installation that is not shown in FIG. 12 may be completed in the manner shown in FIG. 13.

In the showing of FIG. 13, the plates 74 and 74A are mounted as shown in FIG. 2 in connection with a partition 14, and the window installation 374 is defined by same and the corresponding head section 60 that is not shown in FIG. 13. Window installation 374 is similar to that shown in FIG. 12 except that the plates 74 and 74A are on both sides of the window. The glass pane 370 is applied between the stub flanges 106 of the plates 74A and wooden trim members 376 suitably mounted in place about the margin of the casing 42G.

Figure 14:
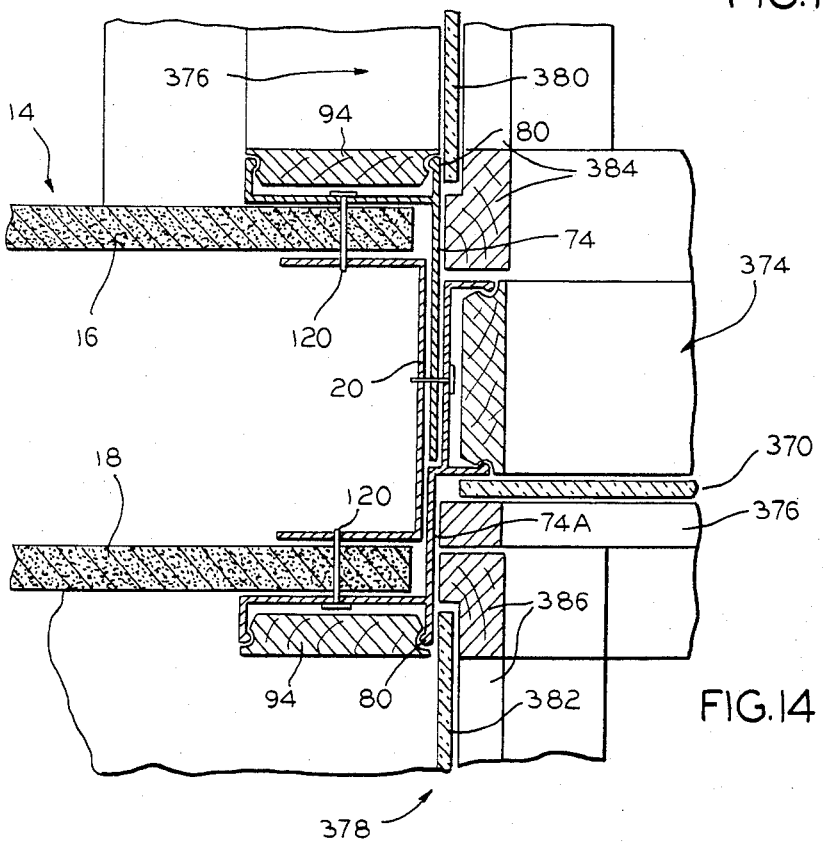
FIG. 14 is a horizontal sectional view illustrating a dry wall partition corner arrangement in which is applied in accordance with the invention a three way window partitioning arrangement.

In the showing of FIG. 14, the plates 74 and 74A are assembled to partition 14 in the manner shown in FIG. 2 and have integrated therewith three window installations 374, and 376 and 378 in a three way window installation, with the installation 374 being as illustrated in FIG. 13. Installations 376 and 378 are similar in having their glass panes 380 and 382 applied between the marginal edge portions 80 of the respective plates 74 and 74A and suitable trim stripping pieces 384 and 386 applied about the window installation.

Figure 15:
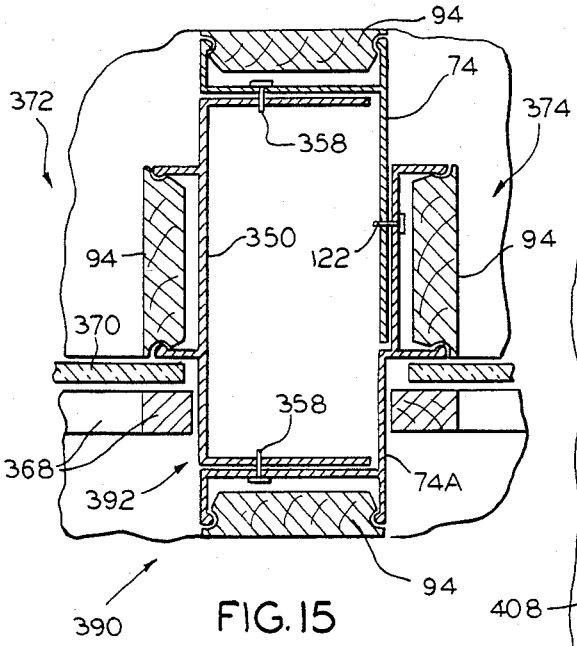
FIG. 15 is a horizontal sectional view illustrating the principles of the invention applied in a running partition employing a mullion separating two glass partitions.

In the showing of FIG. 15, a running glass partition with separating mullions is provided where indicated at 390. The plates 74 and 74A form the window casings of one of the window installations, for instance, installation 374, while the window installation 372 is provided including its plate 350 that is secured to the plates 74 and 74A by the fasteners 358, similar to the showing of FIG. 12, to complete mullion 392.

Figure 16:
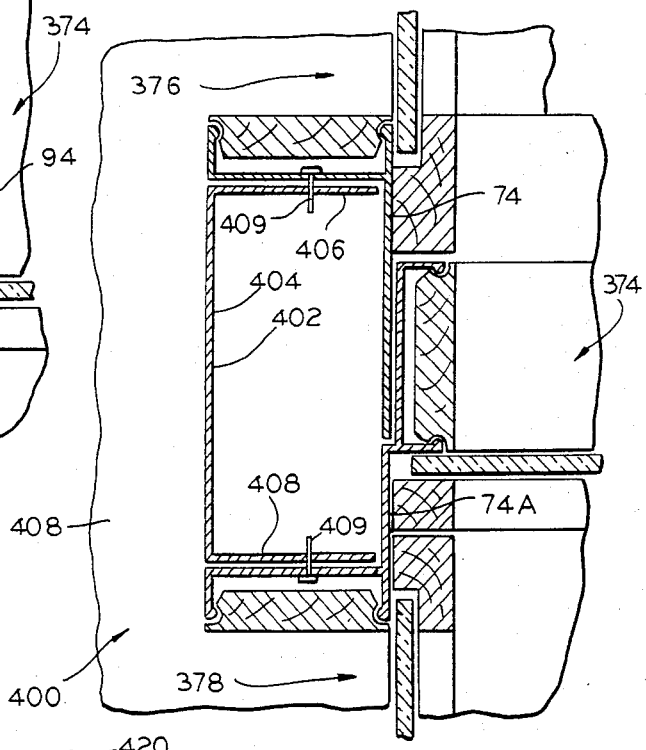
FIG. 16 is a horizontal sectional view illustrating the principles of the invention applied to form a T glass partition intersection.

In the showing of FIG. 16, a glass partition T intersection is provided where indicated at 400, wherein plates 74 and 74A are associated with the previously described window installations 374, 376 and 378, and are secured to channel member 402 in the form of web portion 404 and spaced side flanges 406 and 408, by suitable fasteners 409. Channel member 402 may be disposed adjacent a floor aisle 408, and in upright position the height of plates 74 and 74A to provide the mullion arrangement indicated.

Figure 17:
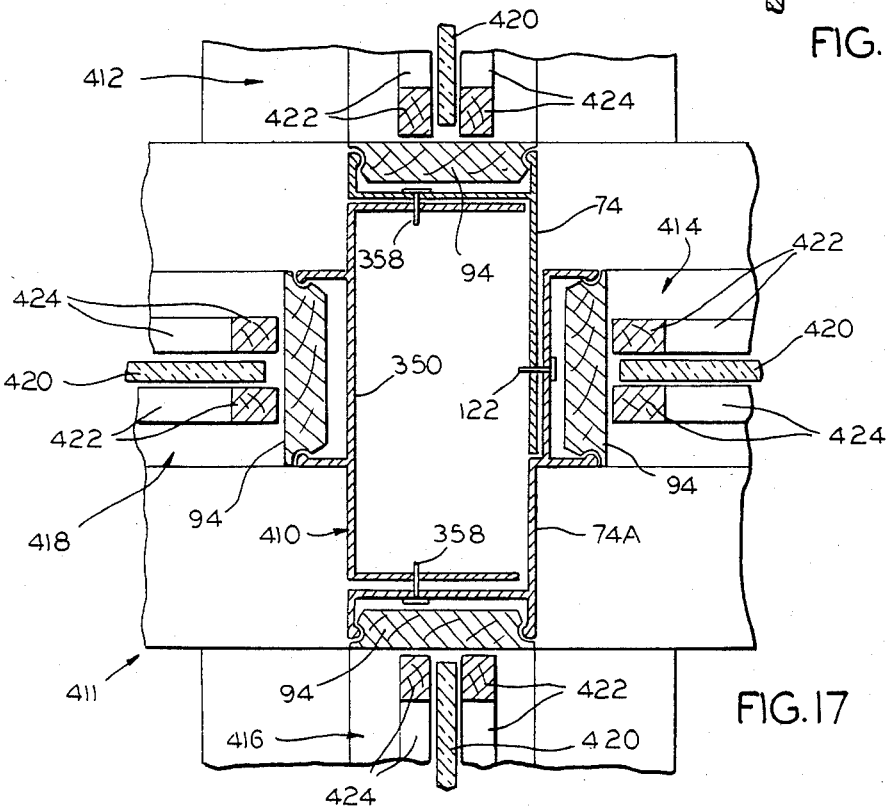
FIG. 17 is a horizontal sectional view illustrating the principles of the invention applied to form a mullion and glass partitions on the four sides of same.

In the showing of FIG. 17, a partition corner arrangement 411 is provided in which the plates 74 and 74A are united with plate 350 to form mullion 410 about which window installations 412, 414, 416, and 418 are provided at right angles to the trim stripping 94 of these framing components. The respective window installations of the illustration of FIG. 17 each comprise glass pane 420 centered on the trim stripping 94 adjacent same, and to either side of which is applied supporting side stripping 422 and 424 that may be formed from wood.

Figure 18:
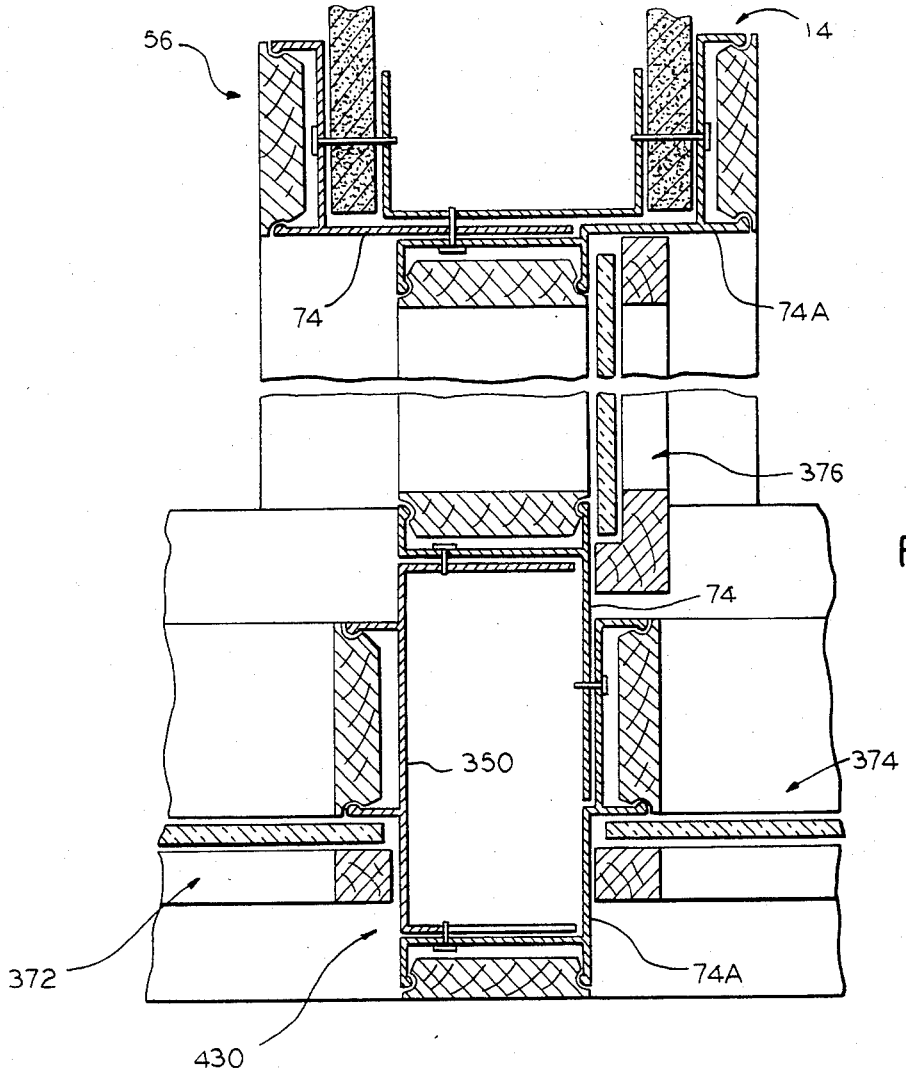
FIG. 18 is a horizontal sectional view illustrating the principles of the invention applied to form a three way glass partition in association with a mullion adjacent a dry wall partition end section.

In the showing of FIG. 18, mullion 430 is formed by securing together plates 74 and 74A with plate 350 and applying thereabout the previously described window installation 372, 374 and 376. The side of the window installation 376 shown at the top of the figure is applied at a dry wall partitioning 14 having plates 74 and 74A applied thereto form a jamb section 56 of the window installation 376.

Figure 19:
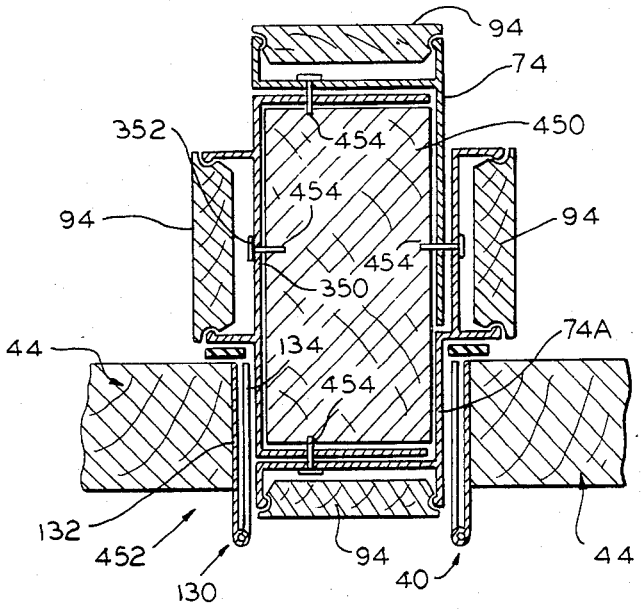
FIG. 19 is a horizontal sectional view illustrating the principles of the invention applied to form a mullion between two oppositely hinged doors.

In the showing of FIG. 19, plates 74 and 74A are assembled together with a plate 350 about a pillar 450 suitably formed from wood (as shown) or metal to define a mullion between a door arrangement 40 on one side of same and a door arrangement 452 on the other side of same. The door arrangement 40 is the same as shown in FIG. 2 while the door arrangement 452 involves a hinge 130 having its leaf 134 suitably affixed to the web portion 352 of plate 350 and the other hinge leaf 132 thereof suitably secured to the second door 44. The plates 74, 74A, and 350, are affixed to each other and to the pillar 450 by suitable fastening devices 454 in a manner comparable to other embodiments of the invention.

Referring now to FIGS. 25 and 26, these figures illustrate a partition cap assembly 460 for suspended ceiling systems in connection with which dry wall partitioning 14 is employed, which assembly employs a number of the improvements hereinbefore described.

The assembly 460 is associated with suspended ceiling system 462 which in and of itself is conventional and comprises a plurality of frame members 464 having the familiar "T" transverse cross-sectional configuration arranged in the usual grid form on, for instance, two foot or four foot centers, with each member 464 being suspended from the overhead floor structure of the basic building superstructure involved, by the familiar suspension wires 466 suitably anchored to the members 464 in a conventional manner, as where indicated at 468 in FIG. 26. The members 464 comprise the familiar main flange or web 470 that is integral with cross flange 472 that is horizontally disposed in the suspended, inverted T, position of the respective members 464, and on which the respective conventional lay-in ceiling tiles 474 are laid to form the suspended ceiling 476.

The partition cap 462 comprises a split frame or casing 42M in the form of a first frame member 70M and a second frame member 72M that are generally similar and are suitably formed from aluminum or the like to include integral with the respective members 70M and 72M the respective plates 74 and 74A that have shapings that are generally similar to those of door frame or casing sections 56 and 58, as indicated by corresponding reference numerals. Thus, the plate portions 74 and 74A of the frame members 70M and 72M include the generally flat base flanges 76, their marginal end portions 78 and 80, the wing flanges 82 and stub flanges 88 that define the respective sockets or recesses 90 that form the respective snap fit mounting devices 92 to which trim strips of the type herein disclosed, such as trim strips 94, are applied, using the rounded bead 96 and indentation 98 snap fit arrangement that has been heretofore described in detail.

The frame member 70M has integral with its web portion 76 the upstanding flange 480 that at its upper end is angled over at right angles thereto to form suspension flange 482 that is to be applied to one side of the T grid member 464 cross flange 472. Frame member 72M is formed with a similar upstanding flange 484 and corresponding mounting flange 486 for application to the other side of the T frame member cross flange 472.

In addition, frame member 70M along its upper marginal edge is formed to define a pair of spaced apart parallel side flanges 490 and 492, the upper of which is shaped to define a bead 96 that is to cooperate in snap fitting relation to a bead 96 formed at the marginal edge of a side flange 493 that is integral with the main flange 484 of frame member 72M. The lower flange 492 of member is a guide flange that is shaped along its projecting edge 496 to guide the entry of the bead 96 of member 72M flange 493 behind the bead 96 of member 70M flange 490 when these components are assembled as indicated in FIG. 26, whereby they form a first snap acting latch device 500 for securing the frame members 70M and 72M in the assembled casing forming relation indicated in FIG. 26. Side flange 493 in the form shown includes vertical stop flange 495.

A second snap action latching device 502 is provided by the members 70M and 72M comprising a cross flange 504 disposed adjacent the base of upstanding flange 480 and extending in parallelism to the plate 74 of member 70M and having along its marginal edge a latching bead 96 that cooperates with a corresponding latching bead 96 that is formed at the marginal edging 78 of the plate 74A (of member 72M).

The conventional ceiling runner 17A is affixed to the members 70M and 72M by the aforereferred to suitable fasteners 122 which also secure the plate 74 and 74A together. Plates 74 and 74A may be formed with the respective indexing flanges 506 and 508 between which the runner 17A is received (the runner 17A being of the usual channel shaped configuration).

In assembling the cap assembly 460, after the suspended ceiling grid has been applied in place in the usual manner to provide the indicated griding of the T shaped grid members 464, the undersides of the cross flanges 472 of the grid members 464 that are to support partition caps of the type illustrated in FIG. 26 are suitably marked (as by using chalk or paint) to indicate the location of the caps 460, and then the caps 460 for particular lengths of partitioning 14 are then assembled in the manner indicated in FIG. 26, prior to the erection of the partitioning 14 involved. For this purpose, the members 70M and 72M that are to form a particular cap 464 for particular lengths of partitioning 14 are selected and cut to the needed lengths, and then are assembled together with the runner 17A that is to be carried by same, and are applied to the grid member 464 they are to be associated with, in the manner indicated in FIG. 26, with the strips 94 being initially left off the respective sockets or recesses 90 thereof. This, of course, involves bringing the respective members 70M and 72M up to the level of the grid member 464 in question and bringing them together on either side of the grid member flange 472 in enclosing relation thereto (as indicated in FIG. 26), with flange 472 under the respective suspension flanges 482 and 486, so that snap acting latch devices 500 and 502 of members 70M and 72M are brought into latching relation, and resting the assembled members 70M and 72M on the grid member 464. The runner 17A is then secured in place with the suitable fasteners 122.

The partition 14 may then be erected in the usual manner below the cap 460, with the wallboard sheets 16 and 18 and studs 20 being fitted between the respective wing flanges 82 and the runner side flanges 22 that are on either side of the cap 460 as the erection proceeds. After the suitable fasteners 24 have been applied between the wing flanges 82 and the studding through the respective sheets 16 and 18, on either side of the partition 14, the assembly of the particular cap 460 is completed by applying the decorative strips 94 to the respective sockets 90.

Referring now to FIG. 27, which is a view comparable to that of FIG. 26, but illustrates a modified partition cap 460A arranged for incorporation in door casing 42 of the double door assembly 40A of FIG. 20, in place of head section 60 (that is shown in FIG. 3). The arrangement of FIG. 27 contemplates that the side casing sections 56 and 58 of the door casing 42 in question will be of such height relative to the suspended ceiling system 476 such that partition cap 460A will fill the gap between the upper ends of the doors and the ceiling tiles 474.

The cap 460A comprises split casing section 42N that is made up of a first frame member 70N and a second frame member 72N which are generally similar to the corresponding frame members 70M and 72M of cap 460, as indicated by corresponding reference numerals. Thus, the frame members 70N and 72N include the respective plates 74 and 74A and their associated parts that have been hereinbefore described in detail, which are respectively integral with the respective upstanding vertical flanges 480 and 484 that are shaped in the same manner as shown in FIG. 26, and as indicated by corresponding reference numerals. Thus, the frame members 70N and 72N are secured together by the respective snap lock devices 500 and 502.

In the cap arrangement 460A, the plates 74 and 74A do not have the indexing flanges 506 and 508, and the channel shaped plate 350 described in connection with the embodiment of FIG. 12 is received between the wing flanges 82 of the respective plates 74 and 74A, with its web portion 352 substantially aligned with stub flanges 88 of plates 74 and 74A. The plate 350 includes the aforedescribed stub flanges 360 and 362 that provide for snap fit application to the socket 90 defined thereby of trim strip 94.

The partition cap 460A is assembled prior to assembly of the door arrangement 40A. The location of the door 40A having been predetermined prior to construction of the partitioning 14 that will be involved in the room space being subdivided, its location may be conveniently marked or laid out on the undersurface of the cross flange 472 of the grid member 464 involved (as by using chalk, paint, etc.). A pair of the frame members 70N and 72N may then be selected, appropriately cut to length, and assembled together in the manner indicated in FIG. 27 on the floor of the room space being assembled, with the strips 94 thereof left off. The channel shaped plate 350 may then be applied thereto with the positioning indicated in FIG. 27, and secured between the respective stub flanges 82 by the connecting devices 122. Prior to this, the plate 74 and 74A may be secured together by a suitable fastener 122.

The strips 94 then may be applied to the respective sockets 90 defined by the cap 460A, and the cap 460A applied to its supporting grid member 464 in the manner already indicated with regard to the embodiment of FIG. 26.

The remainder of the door assembly 40A may then be completed in accordance with the disclosure of this application, following the general arrangement shown in FIGS. 1–3 and 20. The strips 94 and the components defining the respective sockets 90 of the plates 74 and 74A may be appropriately shaped to provide the mitered door frame configuration shown at the top of the door frame shown in FIG. 1, as will be obvious to those skilled in the art.

In the arrangement of FIG. 28, the partition cap 460A is employed as a cap for window installations of the type shown in FIGS. 13–18. For descriptive purposes, FIG. 28 may be considered to be a vertical sectional view taken substantially along line 28—28 of FIG. 13, with the window installation 374 there involved thus including the pane 370, the plates 74 and 74A that are on either vertical side of the window as indicated in connection with the disclosure of FIG. 13, the trim members 110 that are supported by the respective plates 74A in the manner indicated in FIG. 13, and the wooden trim members 376 that are suitably mounted about the margin of the casing 42G of which the cap 460A forms a part.

FIG. 28 also illustrates the basic plates 74 and 74A, arranged as indicated in FIGS. 1–3, employed to form the foot section 510 of the window installation 374. The frame members 74 and 74A are arranged in the manner indicated in FIGS. 1–3, as indicated by corresponding reference numerals, with the respective webs 76 supported on the spaced apart two by four beams 512 and 514 and having their respective wing flanges 82 secured to the respective beams 512 and 514 by the respective fasteners 120. The beams 512 and 514 may be anchored to the basic floor structure 516 in any suitable manner if so desired. Suitable conduiting 518 may be disposed between the beams 512 and 514 if desired for a particular installation. The sockets or recesses 90 of the plate 74 and 74A involved in the base section 510 are equipped with the strips 94 in the manner hereinbefore disclosed.

As is also indicated in FIG. 28, the trim strips 110 are applied to the sockets or recesses 108 in snap fitting relation thereto in the manner described in connection with the disclosure of FIGS. 1–3.

The application of the cap 460A for the window installation 374 is performed in the same manner as in connection with the embodiment of FIG. 27. Thus, the underside of the cross flanges 472 of the grid frame members 464 is marked at the location of the window installation 374, and the cap 460A applied to such member 464 in the manner described with reference to FIG. 27. The casing 42G may then be completed with the cap 460A serving as the head section of same with the side frames of the window installation 374 being defined by employing plates 74 and 74A arranged as indicated in FIG. 13 at either side of the window installation. The indicated window side frames and head section as defined by the cap 460A are suitably shaped for mitering in the manner suggested by the showing of the door arrangement of FIG. 1.

Prior to the application of pane 370 to the window installation, the base section 510 is completed, and after the pane 370 is applied as indicated, trim 376 is suitably applied about the margin of the pane, as by having the trim pieces 376 suitably secured to the plates 74A, or the plates 74, as the case may be, as by employing suitable fasteners such as screws or the like.

It will thus be apparent from the disclosure of FIGS. 25–28 that where the cap arrangements of these Figures are employed throughout a particular floor space between floors of a building superstructure to be subdivided, the entire partitioning subdivisions may be laid out on the grid 362, prior to the application thereto of the ceiling tiles 374. Thus, the caps 460A that are to be applied over door and window installations may be positionally and dimensionally located on the undersides of cross flanges 472 of the grid support members 464 involved (in accordance with a predetermined floor plan), and the remaining lengths of the grid members 464 may be assumed to support a cap 460 for partitioning 14, if that type of layout be suitable for the particular partitioning arrangement to be provided. The caps 460 and 460A may then be assembled and mounted in place about the entire space being subdivided, after which the partitioning 14, the door assemblies, and the window installations may be installed from the floor surface up to the caps. Of course, it is desirable that the caps employed as represented by the caps 460 and 460A have comparable dimensioning horizontally and vertically so that they match about the perimeters of the resulting room space provided by the partition subdivisions.

It will also be apparent that the caps 460 and 460A may be applied with appropriate modifications to the other partitioning illustrations disclosed in this application, with such modifications being made as will be found to be necessary by those skilled in the art.

It will therefore be seen that the invention provides a casing arrangement for forming doorways and window openings which has a variety of uses and applications in addition to being employed for their primary purposes of defining and masking doorways and window openings. Involved is a basic framing component and trim strip therefor, the generic specifics of which are shown in FIGS. 21–24. This basic component may be modified for use at one approach end of a doorway for special installations such as in the embodiments of FIGS. 4–8, but the general purpose use provided by the split frame or casing arrangements illustrated in FIGS. 1 and 2 and 12–19 provides significant flexibility in working with wallboard partitioning and door and window installations to be associated therewith. The invention also provides partition caps for suspended ceiling systems, and similar caps for door and window structures of the type disclosed, which caps have the basic split casing approach and the framing components and trim strips therefor that are involved in the doorway and window opening casings. The plates that form the various casing sections may be and preferably are in the form of economical aluminum extrusions of standard lengths that may be cut to size at the job site as the partitioning and its doors and windows etc. are being installed. The trim stripping arrangement provided in association with same also permits the trim stripping to be of varient aesthetic effects provided in standard lengths that also may be cut to size and snap fitted into place as the installations involved are being completed. The decorative facings presented by the trim strips may be color coordinated or otherwise have their appearances planned in advance so that the decorative effect for any floor of the building to be subdivided as described may be the same or in any predetermined relationship that may be desired.

The securement of the casing frame sections to the partitioning and other components is by way of simple fasteners of any conventional type suitable for the purpose, and in the split framing casing embodiments of the invention, the framing adjusts widthwise to accommodate, for instance, tolerance variations in partition widths, automatically as part of being secured in place.

The various forms of trim stripping or pieces illustrated are interchangeable and the trim stripping that may be applied to the snap fit sockets about the margins of the doorway and window frames and/or along the partition caps, may also be applied to the trim strip socketing within the openings thereby provided, and vice versa.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. For use in forming partitioning in a building structure to define, in the area to be subdivided by the partitioning, room space between a floor and a ceiling, with the ceiling being of the suspended T grid type, a casing arrangement for forming partition end caps, said casing arrangement comprising a pair of cooperating frame members, said casing frame members comprising:

first and second elongated plates each defining a web portion extending longitudinally thereof and having the partition upper end defining side of the respective plates on one side surfacing thereof and the other side surfacing of the respective plates being the partition masking side of same, said plate web portions each having first and second marginal edge portions extending longitudinally of the respective plates along either side edging of said plate web portions, said plates along said first marginal edge portions thereof on said partition masking side of the respective plates each defining a lateral wing flange extending normally longitudinally thereof set back from the terminal edging of said first marginal edge portions respectively, and having along its projecting edge a stub flange paralleling said web portion and terminating in a terminal edging, said first marginal edge portion, and wing flange, and said stub flange of said plates defining a channel shaped recess extending longitudinally of said plates, respectively, means for snap fit mounting a trim piece in said recesses, respectively, for masking same, said plates along said second marginal edge portion of said web portion being generally flat for partition overlying purposes, with said plates being juxtaposed in overlapping relation and said wing flanges being disposed on either side of the partition, and means for supporting said frame members from a common T grid support member, said support means comprising:

each of said plates defining an upright flange portion each having a suspension flange at right angles thereto, with said suspension flanges being disposed in spaced apart opposed relation to receive and rest on the T grid support member along either side of the T grid support member, and including snap action locking means interacting between the respective upright flanges for securing the respective upright flanges together along the T grid support member.

2. The casing arrangement set forth in claim 1 including:

means for anchoring a ceiling runner to said plate web portions on said one side surfacing thereof, and means for anchoring said wing flanges to the partition.

3. The casing arrangement set forth in claim 1 including:

a channel member received between said wing flanges in coextending relation thereto, said channel member defining opposed side flanges along either side thereof and a web portion having one side thereof opposing said plate other side surfacings, means for anchoring said wing flanges to said channel member side flanges, respectively, said channel member web portion having a pair of stub flanges depending therefrom in spaced apart relation and extending longitudinally of said channel member and defining a channel member recess, and means for snap fit mounting a trim piece in said channel member recess for masking said channel member recess.

* * * * *